US007351251B2

(12) United States Patent
Garrett

(10) Patent No.: US 7,351,251 B2
(45) Date of Patent: Apr. 1, 2008

(54) SIMULATED BREAST PACIFYING COMFORT AIDE SYSTEM

(76) Inventor: Vanessa Lynn Blevins Garrett, 13181 Ladybank La., Oak Hill, VA (US) 20171

( * ) Notice: Subject to any disclaimer, the term of this patent is extended or adjusted under 35 U.S.C. 154(b) by 698 days.

(21) Appl. No.: 10/847,970

(22) Filed: May 19, 2004

(65) Prior Publication Data

US 2005/0261738 A1 Nov. 24, 2005

(51) Int. Cl.
*A61J 17/00* (2006.01)

(52) U.S. Cl. ..... 606/236

(58) Field of Classification Search ..... 606/234, 606/235, 236; 215/11.3, 11.4, 11.5, 11.6; 224/148.6, 148.5; 248/102, 104
See application file for complete search history.

(56) References Cited

U.S. PATENT DOCUMENTS 3,590,819 A * 7/1971 Kraft ..... 215/11.4
5,344,355 A 9/1994 Silverstein
5,391,184 A 2/1995 Rosenthal
5,534,014 A 7/1996 Demeritt
5,665,113 A 9/1997 Decker
5,908,439 A 6/1999 Ford
5,993,479 A 11/1999 Prentiss
6,669,064 B2 * 12/2003 Perricone ..... 215/11.3
6,681,944 B1 1/2004 Youssef

* cited by examiner

*Primary Examiner*—Kevin T. Truong

(57) ABSTRACT

An improved comfort aide system for providing breastfed babies with the comforting sensory experience of non-feeding sucking at a breast resembling that of a mother's breast in: smell, form, feel and function. Comprising a permanently sealed main body portion of latex or silicone material, permanently filled and sealed with liquid or other filler substance, shaped like a human female breast. A porous cover having the tactility of human skin encloses the permanently sealed main body. The porous cover may be saturated, sprayed or sprinkled with mom's breast milk. Porous cover dries and retains the smell of mom and her milk for the purpose of scent not eating. Porous cover has a rear opening flap for permitting removal of the permanently sealed main body. Porous cover has a hole placed opposite to opening flap for nipple placement. The nipple comprises areola, teat, and nipple base. The areola and teat protrude through cover hole and nipple base, positioned under the cover hole of the porous cover, is in contact with the permanently sealed main body. The nipple teat and areola is sucked by baby in the same manner baby would suckle to mom's natural lactating breast.

7 Claims, 5 Drawing Sheets

Figure 8 below demonstrates the alternate embodiment present in paragraph 0035 on pages 16 -17 of the amended application.

SIMULATED BREAST PACIFYING COMFORT AIDE SYSTEM

CROSS REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND

1. Field of Invention

This invention relates to infant comforting systems, specifically a comfort aide system acting as a non-feeding pacifying comfort aide weaning device, with the form, feel, smell and function of a human lactating breast to aide a human baby wean from breastfeeding and soothe and comfort baby.

2. Discussion of Prior Art

Parents, doctors and the United States Government recognize breastfeeding as the best source of nutrition for baby. The quality of mother's milk is superior to prepared formulas. Healthcare professionals agree that an infant's sensory experience is particularly important in the formidable stages of development. A mother providing her baby with her breast and the comfort the breast brings is an important aspect of proper child development and bonding between mother and baby.

A baby, and in particular, a breastfed baby innately yearns to be close to its mother's lactating breasts, as frequently as possible, for the breasts offering of comfort; for the breasts scent; the breasts tactility; and ability to satisfy the human babies' sucking needs, as well as for nutritional sustenance. Even when a breastfed baby is not in the act of nursing, in other words not drinking or drawing milk, baby often remains latched onto the breast to suck on the teat, commonly referred to as the nipple. In other words, the baby engages in a pacifying non-feeding or non-eating sucking session, purely for the comfort gained from mom's familiar breast milk scent; the comfort gained from sucking; and the comfort drawn from being close to mom. The baby's desire to remain latched onto mom's nipple, in non-feeding sucking sessions, can and often does hinder the mom's and other care-givers day and evening routines. For example, breastfed babies rarely sleep through the night, waking up several times during the night. Many of the sleep interruptions occur due to the baby's desire to latch-on to mom's breast and suck for comfort, smell mom's familiar milk scent and pacify their sucking needs.

A breastfed baby awakes during the night seeking the comforting familiar scent of mom's lactating breasts. As a result, parents' and caregivers' sleep is interrupted several times during any given night. Parents with breastfed children attest to their desire to have their children sleep uninterrupted for longer periods of time, and for their own need for more sleep.

Weaning a breastfed baby also poses several challenges and difficulties. Baby is unwilling and resists relinquishing the comfort of snuggling and sucking on mom's supple fragrant breast, not eat, but to seek comfort in her bosom. A breastfed baby typically resists mom's attempt to limit nursing sessions and non-feeding pacifying sucking sessions.

Parents and caregivers use prior art like simple pacifiers, pillows, breast shaped bottles and toys in various combinations in an attempt to comfort, accomplish weaning and satisfy baby's sucking needs, however, the prior art can be cited for abundant shortcomings. The greatest shortcoming of the prior art being they do not afford baby a non-feeding pacifying comforting system, intended for baby's operation, designed specifically to resemble in form, feel, and smell the human lactating breast to pacify, comfort, and assist in the weaning process. In addition, the use of prior art for non-feeding pacifying sucking has resulted in a predominance of unnatural sensory experiences; and the use of prior art in the form of a breast functions as feeding devices.

The use of a feeding device in the prior art U.S. Pat. No. 3,590,819 to Kraft (1971) describes a feeding device with a rigid casing, a collapsible milk reservoir, a nonporous covering, an attachable nipple with a metering device for fluid control having a downward opening recess to receive fluid from the reservoir as a means of delivering fluid to baby. Though the apparatus fulfills its desired objective as a nursing device; the prior art does not serve as a weaning pacifier with a pliable permanently sealed permanent breast formed body and porous covering intended for non-feeding sucking, and incapable of fluid deliver or causing baby to suck on air or ingest air. U.S. Pat. No. 6,669,064 to Perricone (2003) describing an infant feeding device with a breast shaped flexible housing, holds a disposable collapsible bag which delivers milk or other fluids through a nipple, said collapsible bag is filled through a screw cap opening at base and secured in housing by restraining straps having an attached sling for position on adult shoulder or adult hand. Though the infant feeding device is shaped like a human breast, it does not function as a device whose main body permanently hold its breast form shape without the need of refillable liquids; which is specifically operational by baby singularly without adult intervention; and this prior art does not have the constant pliability of a human breast, with scented porous covering to satisfy sucking needs without delivery of fluid or air ingested into baby's stomach. U.S. Pat. No. 5,534,014 to Demeritt (1996) describing an elongated pacifier pillow, an apparatus which attempts to fulfill an infants desire to bite and grasp objects. Though the pillow is soft to baby's touch, the elongated shape does not replicate the form, or the function, or the smell of the natural lactating breast.

U.S. Pat. No. 5,665,113 to Decker (1997) describes a pacifier attached to a pillow which also attempts to comfort child with the use of a soft comforting surface. The prior art, however, does not provide the sensory experience of mom's familiar breast scent and shape. U.S. Pat. No. 6,681,944 to Youssef (2004) describes an infant feeding container which attempts to imitate a human breast. This prior art fulfills its function as a feeding device, but it requires many component parts for manufacture and does not provide the functionality of a comfort aide non-feeding system. U.S. Pat. No. 5,993,479 to Prentiss (1999) describes an infant feeding container for a simulated breast nurser. This prior art fulfills its function as a feeding device, but it requires many component parts for manufacture and does not provide the functionality of a comfort aide non-feeding system. U.S. Pat. No. 5,344, 355 to Silverstein (1994) describes a toy with a detachable pacifier, the prior art presents a nipple for sucking; however, it does not simulate the beneficial sensory experience. U.S. Pat. No. 5,908,439 to Ford (1999) describes a nipple attached to an elongated member having a cloth covering which is soft to the touch, however, the shape is unnatural and does not replicate the form, nor function, nor smell of the natural lactating breast. U.S. Pat. No. 5,391,184 to Rosenthal (1995) describes a nipple connected to a bracelet to be worn around a child's wrist; addressing the problem of lost or misplaced pacifiers, however, the prior art does not offer the natural sensation of being close to a mother's lactating breast.

While the prior arts devices fulfill their respective, particular objectives and requirements, the aforementioned patents do not meet the need for a pacifying comfort aide system which is superior in function.

The prior arts use of simple pacifiers with nipples and breast shaped nursing devices are structurally different from the present invention and do not provide a sensory experience similar to the comforting feeling of latching-on to a supple, fragrant breast and engaging in non-feeding pacifying sucking.

BRIEF SUMMARY OF THE INVENTION

The improvement of the present invention meets the needs presented above by substantially imitating the form, feel, smell and function of a natural lactating and a non-lactating breast without operating as a feeding device. The present invention satisfies the breastfed baby's physical need to suck without feeding at mom's breast; to smell the aroma of mom's breast milk; to fondle mom's supple breast; and comforts baby with the familiar size, shape, color, and smell of mom's breast.

The improvement of the present invention a pacifying comfort aide system meets the physical and emotional needs of breastfed baby and formerly breastfed baby to be in proximity to and to latch on to a milk scented breast.

The improvement of the present invention comprises a crested dome shaped body which permanently holds its shape form, it contents being permanently sealed within, configured to look like a human female breast; having a supple quality; a porous cover having the tactility of human skin; and nipple portion comprising an areola, a teat and a nipple base, serving as a non-feeding source. The present invention's design is easily laundered; visually resembles a mom's breast; feels like mom's lactating breast; has the versatility to smell like mom's lactating breast and comforts baby as mom's lactating breast. The present invention serves as a pacifying device which does not deliver liquid and plays a role in assisting baby be away from mother's breast.

OBJECTS AND ADVANTAGES

Accordingly, several objects and advantages of the improved present invention exist. The first object is to provide a pacifying comfort aide system to comfort baby with out feeding baby, with a system resembling the human female breast, which is the entity breastfed babies most desire. A second object is to provide a pacifying comfort aide system which smells like baby's mother's breast milk. A third object is to provide a pacifying comfort aide system which visually resembles baby's mother's lactating breast. A fourth objective is to provide a pacifying comfort aide system to help ease the weaning process. A fifth objective is to provide a pacifying comfort aide system which helps make baby's temporary physical separation from mother easier. A sixth objective is to provide a pacifying comfort aide system which comes closest to providing baby with the comforting sensation baby's mother gives with her breast. A seventh objective is to provide a pacifying comfort aide system which assists baby put him/herself back to sleep without mom's actual breast to suckle; thereby giving the parents/caregivers more uninterrupted sleep. An eighth objective is to provide a pacifying comfort aide system which is portable and can be used by baby unilaterally in various places, such as a crib, car seat, sitting up, laying down. A ninth objective is to provide a pacifying comfort aide system which is easy to maintain and clean. The tenth objective is to provide a pacifying comfort aide system which uses few parts to manufacture and requires easy assembly. An eleventh objective is to provide a pacifying comfort aide system which feels like a human lactating breast and provides a beneficial sensory experience for baby. A twelfth objective is to provide baby with a pacifying comfort aide non-feeding system to satisfy the baby's sucking needs. A thirteenth objective is to provide a pacifying comfort aide system that is not a means by which to deliver nutrition or other edible matter or materials.

Further objects and advantages of the improvement of the present invention will become apparent from a consideration of the drawings and ensuing description.

LIST OF REFERENCE NUMERALS

Figure 1:
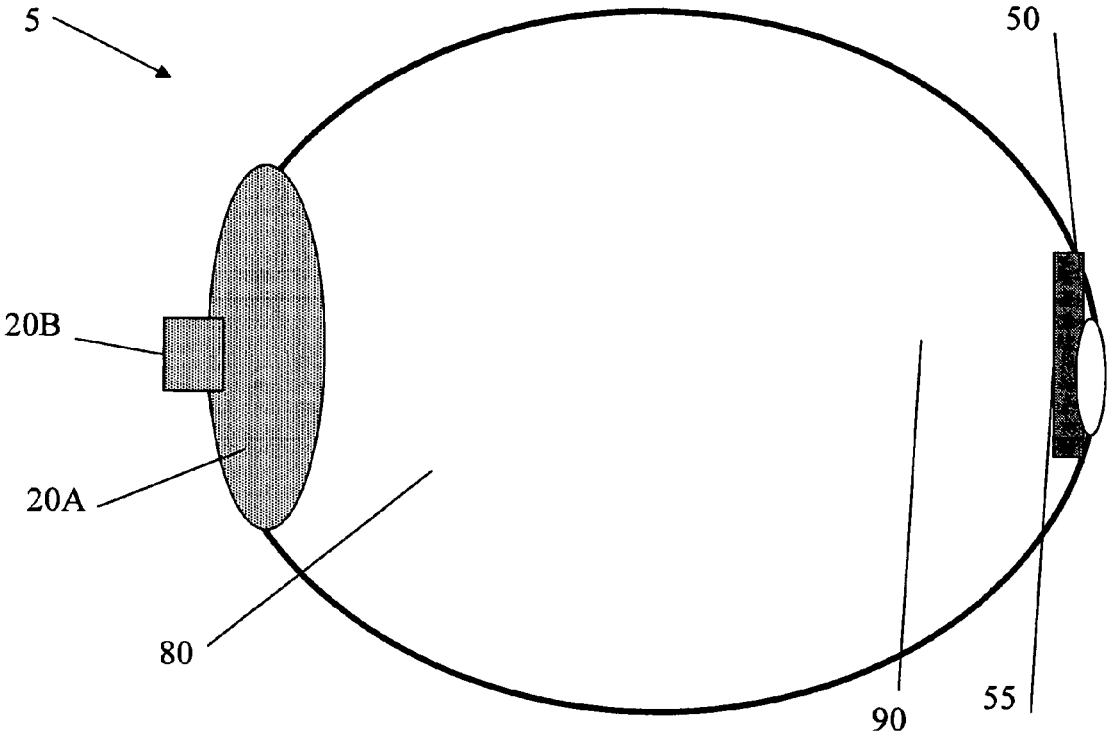
FIG. 1 is a perspective view of a new simulated breast pacifying comfort aide system.

5 simulated breast pacifying comfort aide system
10 permanently sealed main body
20 nipple portion
20A areola
20B teat
20C nipple base
30 permanently located filler substance
40 porous cover
50 opening flap
55 fastening device
60 cover hole
80 crested first end
90 second end

DESCRIPTION OF INVENTION

With reference now to the drawings, and in particular to FIGS. 1 through 8 thereof, a new simulated breast pacifying comfort aide system embodying the principles and concepts of the present invention and generally designated by the reference numeral 5 will be described.

Illustrative FIG. 1 discloses a simulated breast pacifying comfort aide system 5 having a nipple 20B and areola 20A permanently affixed to or made part of permanently sealed maid body 10 at nipple base 20C; or a nipple 20B and areola 20A otherwise attached to permanently sealed main body 10 by a porous cover 40 at the cresting first end 80. The simulated breast pacifying comfort aide system 5 of FIG. 1 further discloses a second end 90 having fastening device 55 attached at opposite ends of opening flap 50. Velcro™, Velcro USA Inc., Manchester, N.H., strips are employed in the depicted example. Fastening device 55 may be any suitable type of fastening device such as a hook-and-loop fastener, snaps, buttons, etc.

Figure 2:
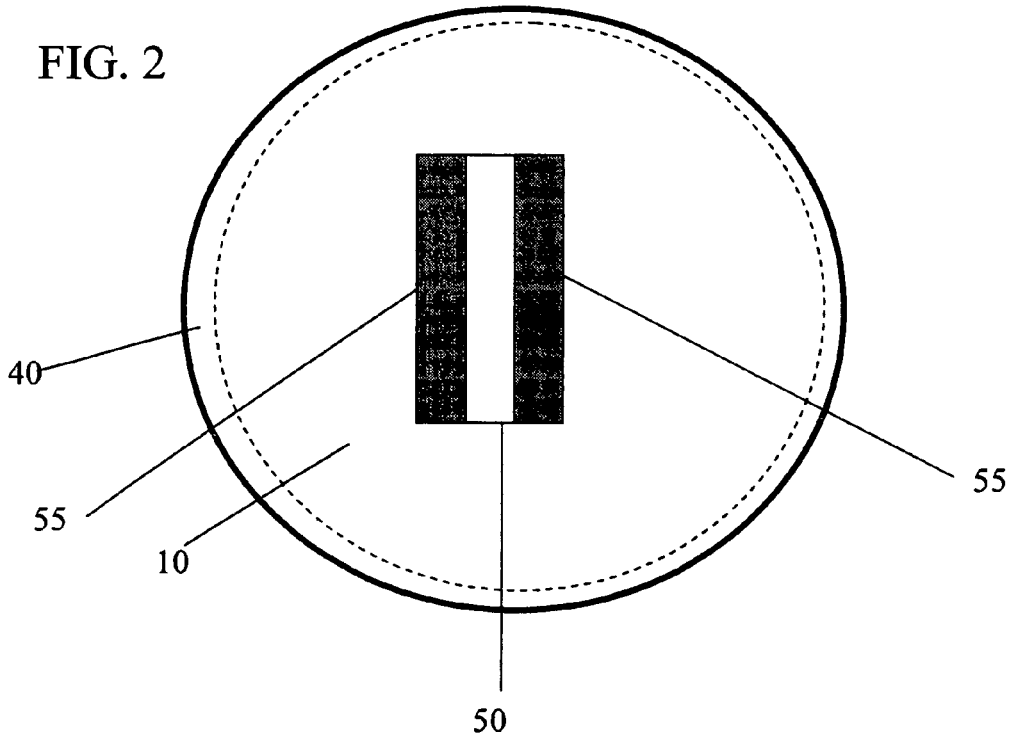
FIG. 2 is a rear view of the present invention including a fastening device of porous cover.

Illustrative FIG. 2 discloses a rear view of the second end 90 detailing the porous cover 40 attached to the exterior surface of permanently sealed main body 10. Permanently sealed main body 10 is comprised of silicone, rubber or latex or other material which provides a soft, supple and squeezable characteristic of the simulated breast pacifying comfort aide system 5. Permanently sealed in body 10 is designed for holding a permanently located filler substance 30. Permanently located filler substance 30 in the present embodiment is water, however, any group of material my be selected form the group of non-toxic gel type materials, silicone, or water cells applied in an amount which would provide soft supple and squeezable characteristics of the simulated breast pacifying comfort aide system 5. Permanently sealed main body 10 of breast simulating pacifying comfort aide system 5 simulates various breast sizes and degrees of suppleness of the human female lactating breast. In an embodiment, permanently sealed main body 10 is comprised of a silicone or latex material, a permanently located filler substance 30 such as water, liquid or gel silicone or other suitable substance is positioned permanently within the permanently sealed main body 10 and stays in place by the permanence of said permanently sealed main body 10's seal. Permanently sealed main body 10 when filled with the permanently located filler substance 30 maintains a degree of firmness and suppleness in order to remain pliant; thereby maintaining the quality of a lactating human breast.

Figure 6:
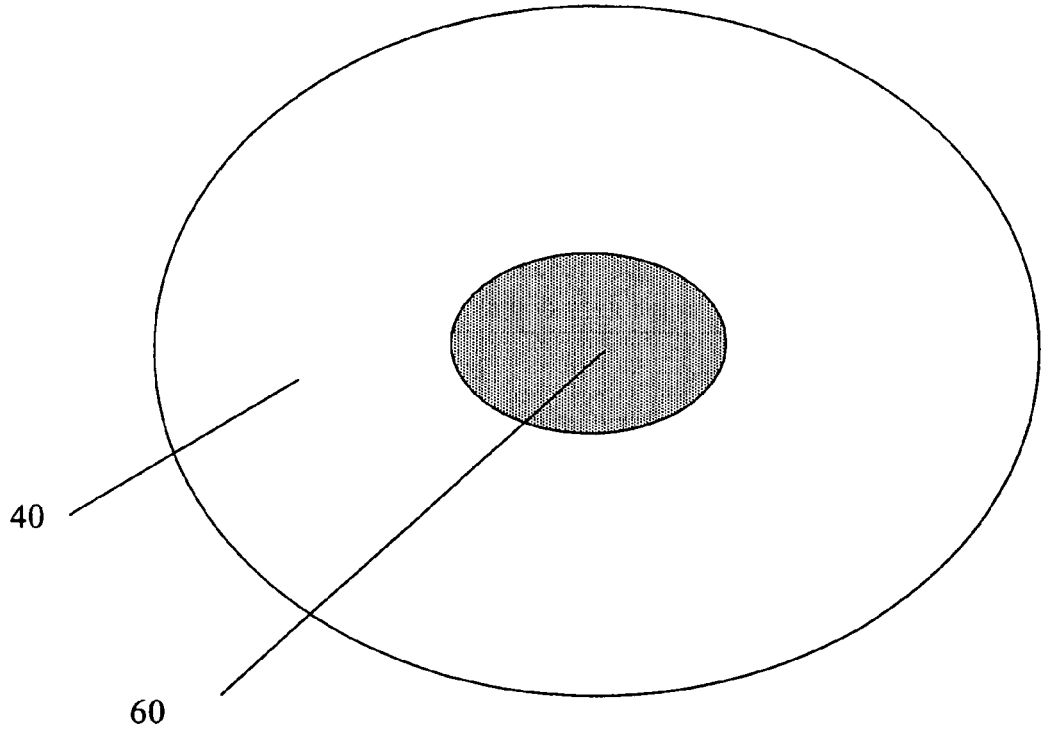
FIG. 6 is an elevational view of porous cover.

Illustrative FIG. 6 discloses shape of porous cover 40, without permanently sealed main body 10 in its interior. Porous cover 40 having a cover hole 60 for nipple placement.

Figure 7:
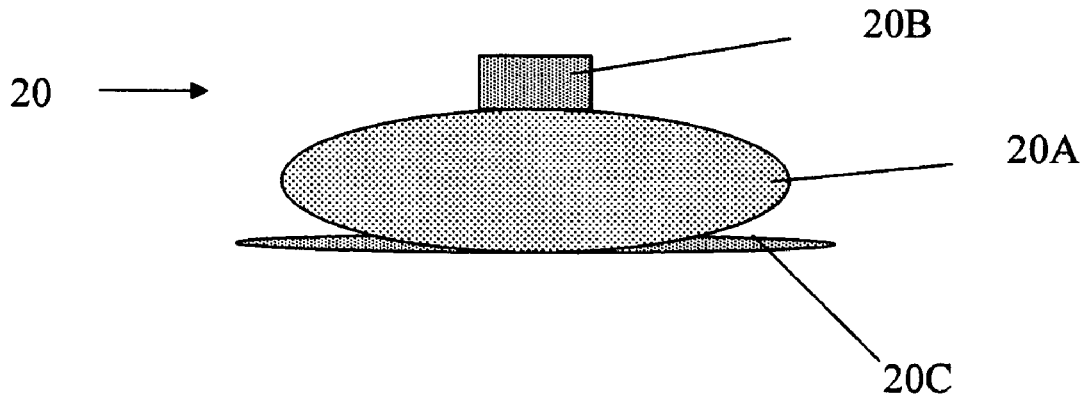
FIG. 7 is a perspective view of nipple portion.
Figure 8:
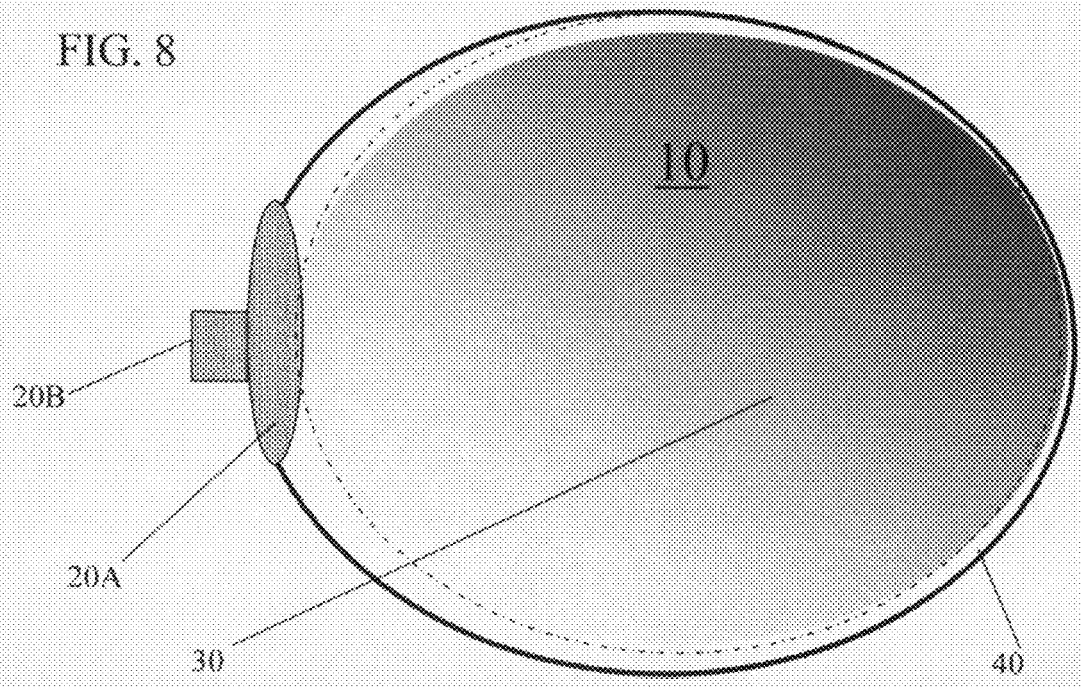
FIG. 8 is a perspective view of nipple portion, without nipple base, permanently affixed to permanently sealed main body.

Illustrative FIG. 7 discloses a nipple portion 20 comprising a nipple base 20C, areola 20A and teat 20B. Areola 20A and teat 20B comprised in nipple portion 20 visually simulate the anatomy of the human female breast. Nipple 20 should be formed of a substantially resilient material such as rubber, latex, silicone or other conventionally known resilient materials. A nipple designed to be similar in shape to a mother's nipple during breast feeding, elongating when baby sucks, is preferable. The preferred embodiment illustrated for nipple 20 is a Playtex Nurser System Natural Action Nipple-™, Playtex Products Inc., Dover, Del., bottle nipple which comes in a dark color resembling the areola and nipple of a human female breast. In addition, the Playtex Natural Action Nipple-™ is larger then most commercially sold nipples, so it more closely resembles the size and shape of a human female breast. Any variety of commercially available non-toxic, synthetic nipples may be used.

Figure 3:
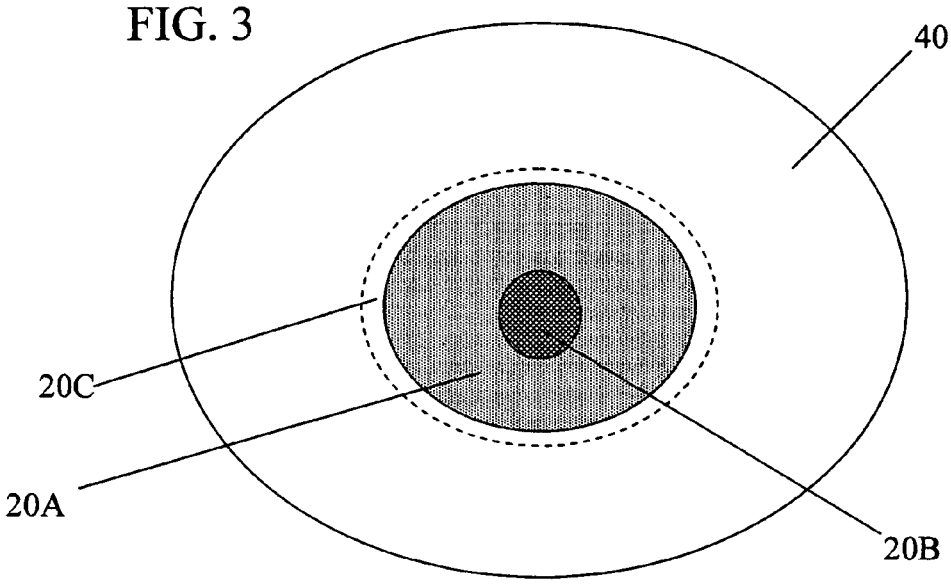
FIG. 3 is an elevational view of the present invention.

Illustrative FIG. 3 discloses an elevational view of the porous cover 40 on the exterior surface of permanently sealed main body 10. Porous cover 40 simulates the feel of human skin, smooth and comforting to baby's touch, stimulating baby's senses. In an embodiment, porous cover 40 is comprised of nylon/spandex blend, similar to that of a woman's seamless bra cup from a brassiere sold in department stores; or other porous material having a friendly tactile quality which feels like human skin. Porous cover 40 is embodied in various skin tones to resemble skin tones of blacks, whites, Hispanics, Asians, etc. Porous cover 40 in operation is saturated, sprayed or sprinkled with mom's breast milk. Breast milk dries on porous cover 40, leaving porous cover 40 with the inviting and familiar scent of mom's breast milk. Porous cover 40 is removable for washing. Nipple base 20C is placed under cover hole 60 at cresting first end 80 and nipple base 20C is securely held in place on permanently sealed main body 10 by porous cover 40. The areola 20A and teat 20B of nipple portion 20 protruding through cover hole 60 extending beyond permanently sealed main body 10. Nipple base 20C of nipple portion 20 may be held in place by porous cover 40 if nipple portion 20 is not permanently affixed to crested first end 80 of main body 10.

Figure 4:
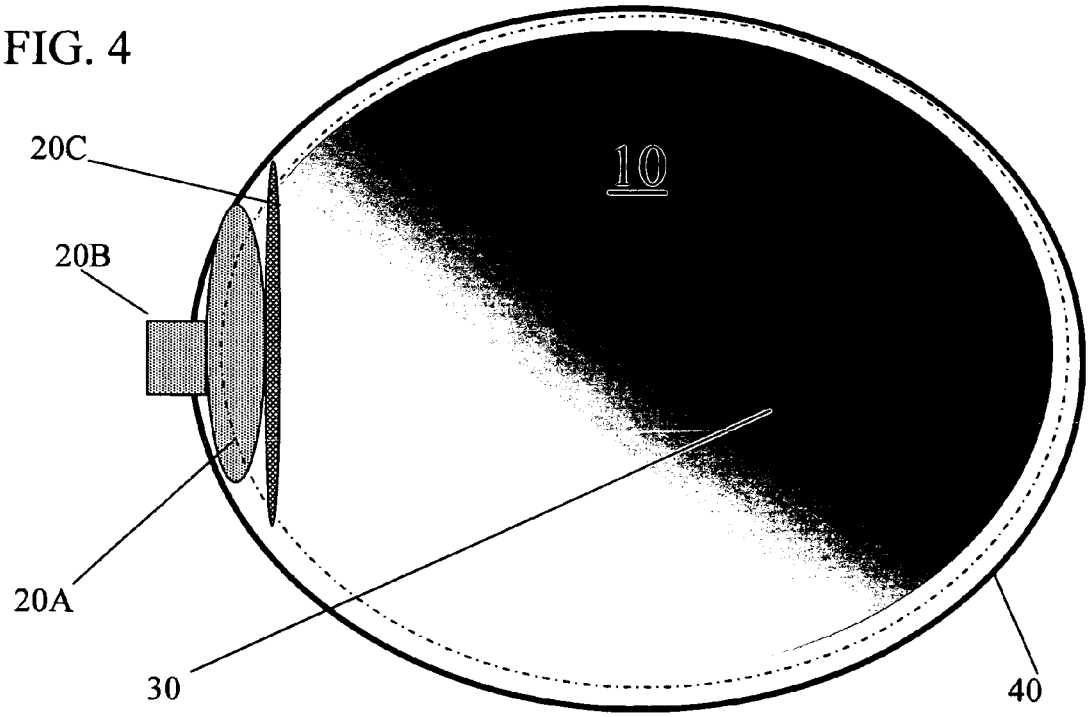
FIG. 4 is a cross sectional view of additional embodiments which includes a permanently filled and sealed main body, and a removable porous cover.

Illustrative FIG. 4 discloses a cross sectional view of permanently sealed main body 10 with permanently located filler substance 30 positioned within permanently sealed main body 10; with permanently sealed main body 10 having the shape and form of a human lactating breast. Porous cover 40 is in contact with the exterior surface of filled permanently sealed main body 10. Nipple base 20C positioned on permanently sealed main body 10 securely held in place by porous cover 40.

Figure 5:
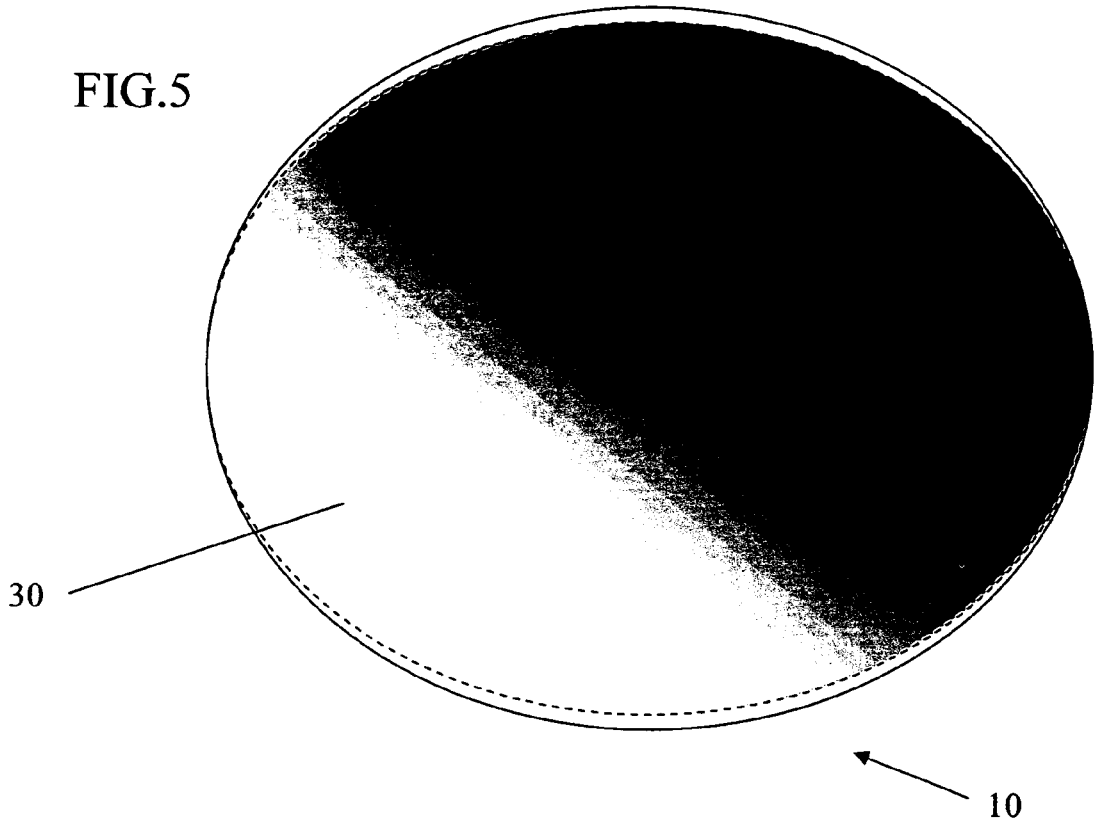
FIG. 5 is a perspective view of the permanently filled and sealed main body.

Illustrative FIG. 5 discloses permanently sealed main body 10 with permanently located filler substance 30 positioned within permanently sealed main body 10.

OPERATION OF INVENTION

Permanently sealed main body 10 of breast simulating pacifying comfort aide system 5 simulates various breast sizes and degrees of suppleness of the human female lactating breast. In an embodiment, permanently sealed main body 10 is comprised of a silicone or latex material, a permanently located filler substance 30 such as water, silicone or other suitable substance is positioned within permanently sealed main body 10 and sealed within the permanently sealed main body 10. Permanently sealed main body 10 when filled with permanently located filler substance 30 maintains a degree of firmness and suppleness in order to remain pliant; thereby maintaining the quality of a lactating human breast. Permanently sealed main body 10 once filled with permanently located filler substance 30 will hold its form in perpetuity and cannot be emptied or refilled by user.

Baby will hold, squeeze, fondle, caress and manipulate permanently sealed main body 10 with porous cover 40 attached to the exterior surface of permanently sealed main body 10 as a breast feeding baby does while suckling at its mothers breast, for the purpose of pacifying non-feeding comfort. Porous cover 40 simulates the feel of human skin, smooth and comforting to baby's touch, stimulating baby's senses. Porous cover 40 simulates skin, manufactured in various skin hues and tones; visually resembling the skin color and hue of mom's actual breast. Porous cover 40 in operation is saturated, sprayed or sprinkled with mom's breast milk for the purpose of smell recognition, not feeding. Breast milk dries on porous cover 40, leaving porous cover 40 with the inviting and familiar scent of mom's breast milk. Porous cover 40 may be re-saturated with breast milk any number of times for the purpose of smell recognition, not feeding. In an embodiment, porous cover 40 is comprised of nylon/spandex blend, similar to that of a woman's seamless bra cup from a brassiere sold in department stores; or other synthetic material or cotton or cotton plended material having a friendly tactile quality which feels like human skin. Porous cover 40 embodied in various skin tones to resemble skin tones of blacks, whites, Hispanics, Asians, and other peoples around the world. Porous cover 40 is removable for washing.

Permanently sealed main body 10 is inserted into porous cover 40 and removed from porous cover 40 through opening flap 50 on the perimeter of porous cover 40. Opening flap 50 is positioned at the second end 90 of permanently sealed main body 10. Opening flap 50 is closed by fastening device, 55. A fastening device 55 is assembled on opposite ends of opening flap 50. Opposite ends of fastening device 55 are brought together to close Opening flap 50. Velcro™, Velcro USA Inc., Manchester, N.H., strips are employed in the depicted example. Fastening device 55 may be any suitable type of fastening device such as a hook-and-loop fastener, snaps, buttons, etc.

Nipple 20 is inserted through cover hole 60 of porous cover 40, with nipple base 20C in contact with crested first end 80. Porous cover 40 maintains nipple 20 tightly and securely in place against permanently sealed main body portion 10 to crested first end 80 of main body 10, if in the alternative embodiment nipple 20 is not permanently affixed. Nipple 20 comprises an areola 20A, teat 20B and nipple base 20C. Areola 20A and teat 20B comprised in nipple 20 visually replicate the anatomy of the human female breast. Baby wraps its mouth around the teat 20B and a small or minute portion of the areola 20A as if suckling its own mothers lactating breast. Nipple 20 should be formed of a substantially resilient material such as silicone, rubber, latex or other conventionally known resilient materials. A nipple designed to be similar in shape to a mother's nipple during breast feeding, elongating when baby sucks, is preferable.

The preferred embodiment illustrated for Nipple 20 is a Playtex Nurser System Natural Action Nipple™, Playtex Products Inc., Dover, Del., bottle nipple which comes in a dark color resembling the areola and nipple of a human female breast. In addition, the Playtex Natural Action Nipple™ is larger then most commercially sold nipples, so it more closely resembles the size and shape of a human female breast. Any variety of commercially available non-toxic, synthetic nipples may be used.

DESCRIPTION AND OPERATION OF ALTERNATIVE EMBODIMENTS CONCLUSION, RAMIFICATIONS AND SCOPE OF INVENTION

Thus the reader will see that the simulated breast pacifying comfort aide system provides a satisfying breast pacifier like substitute for mom's breast. The present invention is a pacifying comfort aide system which baby can snuggle, suckle, smell, caress and fondle, to satisfy baby's need to be close to mom's breast, and satisfy baby's need for soothing pacifying non-feeding sucking sessions.

While my above description contains much specificity, these should not be construed as limitations on the scope of the invention, but rather as an exemplification of one preferred embodiment thereof. Many other variations are possible. Alternative embodiments of the nipple include a nipple incorporated and permanently affixed to the main body; nuances in nipple shape; nuances in color; various means of attachment of nipple to porous cover; or other adjustments within the scope of the invention. In an alternate embodiment nipple 20 is to be made part of, affixed to permanently, permanently sealed main body 10 at nipple base 20C to the crested first end 80. The areola 20A and teat 20B of nipple portion 20 protruding through cover hole 60 of porous cover 40 extending beyond permanently sealed main body 10. Said nipple 20 shaped to closely resemble that of the human female lactating breast, areola 20A, teat 20B and nipple base 20C in a darkened color. Alternate embodiments include, the use of most commercially sold nipples, having a teat area, areola area and nipple base area, closely resembling the size and shape of a human female breast. Embodiments of the permanently sealed main body portion include latex, rubbers, silicone, foam or any other material which holds its shape, is pliable and is safe for use. The permanently sealed main body portion may be permanently filled and sealed with water, saline solution, silicone gel, other non-toxic gels, foam or any other type of material which provides soft, supple and squeezable characteristics for the simulated breast comfort aide system. The permanently sealed main body portion may be produced in various human breast sizes, similar to the breast size cups of women. Alternative porous cover embodiments include nylon, spandex, nylon-spandex blend, cotton, cotton-polyester blend or any other material which has the tactile quality of human skin. The porous cover can be embodied in various ethnic skin tones representing blacks, whites, Asians, Hispanics and the like. Alternative fastening device embodiments include any safe means by which to latch close the flaps of the porous cover.

The present invention principally attempts to imitate the comforting sensory experience of non-feeding natural breast sucking. While the formulation of new materials and processes may enable enhancements in future designs, the claims anticipate such evolution, permitting appropriate design alternatives within the broader scope. Accordingly, the scope of the invention should be determined not by the embodiments(s) illustrated, but by the appended claims and their legal equivalents.

I claim:

1. A simulated breast pacifying comfort aide system comprising a permanently sealed main body, having no openings and incapable of delivering or drawing liquids therefrom once sealed, domed shaped member having a crest resembling that of a woman's lactating breast, constructed of a pliable material having a crested first end and a second end having no means for delivery of liquid, nutrition or feeding;

a non-removable permanently located filler substance, positioned within the permanently sealed main body;

a porous cover, substantially shaped in form of the permanently sealed main body, to encase said permanently sealed main body resembling a woman's lactating breast and;

a nipple portion having a teat, areola and nipple base, the nipple portion from which no liquids or other substances can be drawn from;

a means for said non-removable permanently located filler substance to be applied into said permanently sealed main body and a means to permanently seal said non-removable permanently located filler substance into said permanently sealed main body, said non-removable permanently located filler substance maintains, gives shape to said permanently sealed main body's breast form; said porous cover coupled to exterior surface of said permanently sealed main body;

the improvement wherein said porous cover is constructed of material which is porous, maintains or holds an amount of human breast milk sufficient to emanate the smell of said human breast milk for smell and not for eating purposes; said nipple being operationally couplable to said permanently sealed main body with said nipple base being in environmental communication with said permanently sealed main body's crested end; said nipple portion's areola and teat being position-able to extend beyond said crested end of said permanently sealed main body; whereby a baby can suck, not to draw liquid from and incapable of drawing liquid or other substances, on said nipple and cuddle said simulated breast pacifying comfort aide system to draw pacifying comfort from said simulated breast pacifying comfort aide system while in sitting or lying position.

2. The simulated breast pacifying comfort aide system of claim 1 further including an opening flap on perimeter wall of said porous cover facilitating access to said permanently sealed substance filled main body and a cover hole on the perimeter wall of said porous cover positioned opposite said opening flap; said porous cover is placed on the exterior surface of said permanently sealed substance filled main body with said cover hole positioned at said crested first end of said permanently sealed substance filled main body; said cover hole providing a means for said nipple attachment.

3. The simulated breast pacifying comfort aide system of claim 1 wherein said porous cover is fabricated of a soft material selected from a list including natural and synthetic fibers, said porous cover simulating skin of human breast.

4. The simulated breast comfort aide system of claim 1 further including a plurality of porous covers, each one of said porous covers being operationally couplable to said permanently sealed substance filled main body individually, each one of said plurality of porous covers having a unique color or hue relative to each other, said plurality of porous covers representing a multitude of human skin colors.

5. The simulated breast pacifying comfort aide system of claim 2 further including a fastening device secured on opposite ends of said opening flap.

6. The simulated breast pacifying comfort aide system of claim 1, wherein said permanently sealed substance filled main body is composed of thermoplastic, elastomer, thermoset rubber, silicone rubber, latex, resilient foam material, or other pliant material.

7. A simulated breast pacifying comfort aide system comprising a main body, said main body having a filler substance of soft silicone or other pliable substance permanently located within said main body's inner core, with said main body being permanently sealed to permanently retain said filler substance, maintaining the consistency and weight of natural human breast tissue, shaped in form to resemble a human lactating breast;

a porous cover substantially conforming to the shape of said permanently sealed main body, resembling the tactility of a woman's lactating breast skin and;

a nipple having a teat, areola and nipple base;

a permanently located filler substance;

a means for said permanently located filler substance to be inserted into said main body and a means to permanently seal said permanently located filler substance into said permanently sealed main body, said porous cover coupled to exterior surface of said permanently sealed main body; and said nipple portion being operationally couplable to said permanently sealed main body with said nipple base being in environmental communication with said main body portion; the improvement wherein said cover's material being porous, maintains or holds an amount of human breast milk sufficient to emanate the smell of said human breast milk; whereby a baby can suck said nipple and cuddle said simulated breast pacifying comfort aide system drawing comfort, not food or other substances, from said breast simulating pacifying comfort aide system while in sitting or lying position.

* * * * *